US005810201A

United States Patent [19]

Besse et al.

[11] Patent Number: 5,810,201

[45] Date of Patent: Sep. 22, 1998

[54] INTERACTIVE DISPENSER FOR PERSONAL USE CHEMICAL OR PERSONAL CARE CHEMICAL THAT PROVIDES A MESSAGE PROMPTED BY USER PROXIMITY

[75] Inventors: Michael E. Besse, Golden Valley; Thomas E. Heinzen, Burnsville; Terry J. Klos, Victoria; Keith D. Lokkesmoe, Savage, all of Minn.; John J. Rolando, Greensboro, N.C.; James J. Tarara, Woodbury, Minn.

[73] Assignee: Ecolab Inc., St. Paul, Minn.

[21] Appl. No.: 681,264

[22] Filed: Jul. 22, 1996

[51] Int. Cl.[6] ..... B67D 5/32

[52] U.S. Cl. ..... 222/39; 222/52; 222/78

[58] Field of Search ..... 222/39, 78, 95, 222/214, 52, 325

[56] References Cited

U.S. PATENT DOCUMENTS

| | | | |
|---|---|---|---|
| Re. 33,746 | 11/1991 | Lucas | 239/744 |
| D. 304,791 | 11/1989 | DeVigili | D6/542 |
| D. 334,106 | 3/1993 | Piper | D6/542 |
| 2,771,219 | 11/1956 | Dewey | 222/93 |
| 2,777,607 | 1/1957 | Bellandi | 222/39 |
| 3,122,130 | 2/1964 | Brown et al. | 119/71 |
| 3,792,437 | 2/1974 | Blumenthal et al. | 340/152 |
| 4,036,404 | 7/1977 | Robinson | 222/39 |
| 4,140,222 | 2/1979 | Francavilla | 211/65 |
| 4,185,413 | 1/1980 | Goldfarb et al. | 222/78 X |
| 4,477,000 | 10/1984 | Arabian | 222/135 |
| 4,488,668 | 12/1984 | Flaska et al. | 222/548 |
| 4,509,543 | 4/1985 | Livingston et al. | 134/57 |
| 4,606,085 | 8/1986 | Davies | 4/623 |
| 4,636,881 | 1/1987 | Brefka et al. | 360/74.1 |
| 4,756,321 | 7/1988 | Livingston et al. | 134/56 |
| 4,896,144 | 1/1990 | Bogstad | 340/691 |
| 4,921,131 | 5/1990 | Binderbauer et al. | 222/52 |
| 4,938,384 | 7/1990 | Pilolla et al. | 222/52 |
| 4,989,755 | 2/1991 | Shiau | 222/63 |
| 5,025,372 | 6/1991 | Burton et al. | 364/406 |
| 5,158,212 | 10/1992 | Sirhan | 222/175 |
| 5,199,118 | 4/1993 | Cole et al. | 4/19 |
| 5,228,595 | 7/1993 | Booker | 222/78 |
| 5,230,648 | 7/1993 | Kelley et al. | 446/74 |
| 5,248,066 | 9/1993 | Olson et al. | 222/105 |
| 5,301,836 | 4/1994 | Luu | 222/78 |
| 5,625,908 | 5/1997 | Shaw | 4/623 |

FOREIGN PATENT DOCUMENTS

| | | |
|---|---|---|
| 0 079 853 | 5/1983 | European Pat. Off. . |
| 0 468 062 | 1/1992 | European Pat. Off. . |
| 90/01762 | 2/1990 | WIPO . |

*Primary Examiner*—Gregory L. Huson

*Attorney, Agent, or Firm*—Merchant, Gould, Smith, Edell, Welter & Schmidt, P.A.

[57] ABSTRACT

An interactive dispenser, used to provide a powdered, liquid or personal use or care chemical, can provide a message prompted by the proximity of a user to a sensor. Personal care liquids can include hand cleaners, hand and body lotion, sun blocks, sun screens, poison ivy treatment materials, burn ointments, body powders, solid hand soap bars, etc. A variety of messages can be provided to the user including a reminder to use the materials provided by the dispenser, instructional information, safety information, use directions for the chemical, use directions for the dispenser, or any other message. The message can be provided in a visual message such as an electronic scroll, an aural message derived from an electronic voice synthesizer. Such a message can be combined with a musical program, other light displays, etc. The sensor can be mounted on the dispenser in the form of a push button, an actuator triggered by the installation of new chemical, can be a motion sensor detecting the presence of a user, can be a remote sensor sensing the presence of a user at a remote site from the dispenser, involving the use of equipment used in conjunction with the dispenser such as a urinal, toilet, bathroom sink, etc. The overall purpose of coupling a user proximity generated prompt to generating a message is the improved efficacy of use of the dispenser or its chemical contents.

29 Claims, 3 Drawing Sheets

Figure 1:
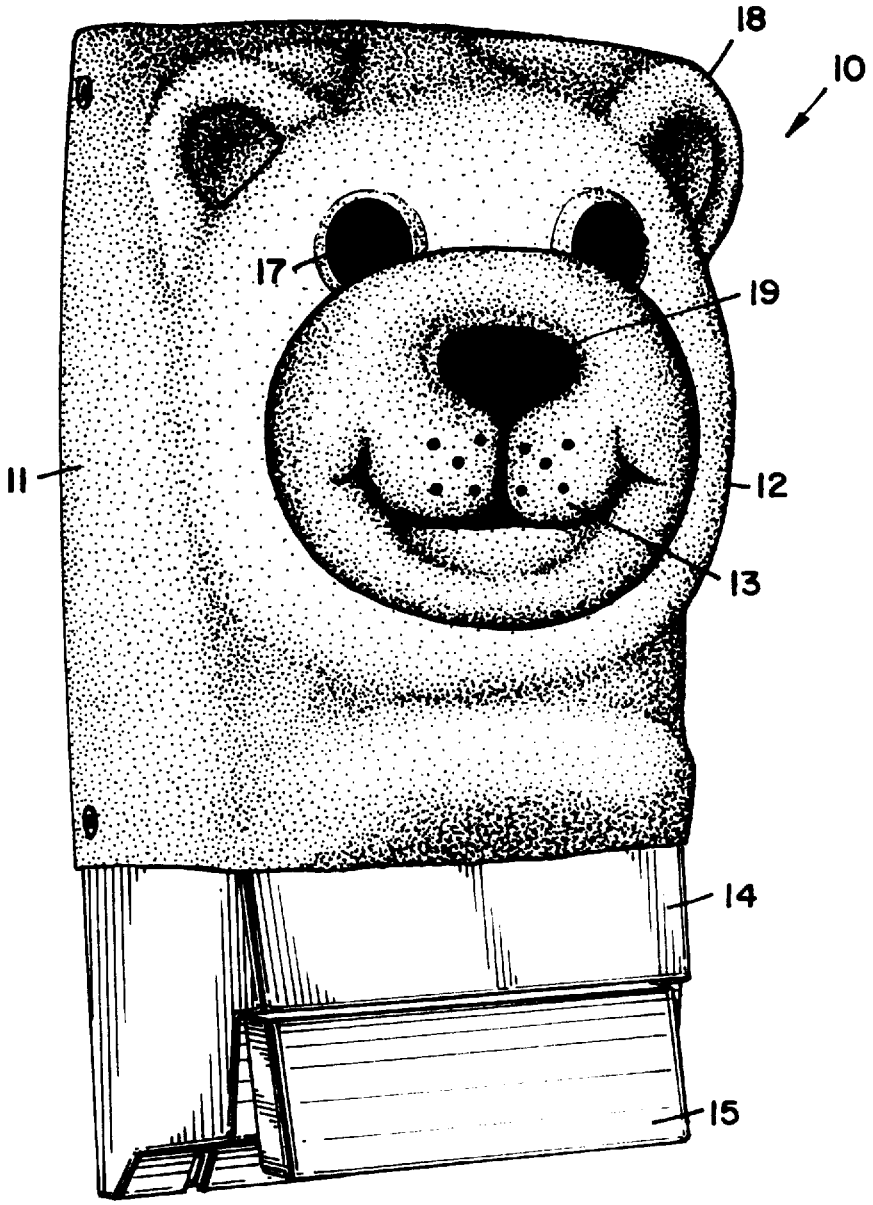

INTERACTIVE DISPENSER FOR PERSONAL USE CHEMICAL OR PERSONAL CARE CHEMICAL THAT PROVIDES A MESSAGE PROMPTED BY USER PROXIMITY

FIELD OF THE INVENTION

The invention relates to an interactive dispenser that can provide a liquid chemical product to a user (i.e.) an adult or child or other person in a use locus in response to a proximate user input. The dispenser can also provide a message related to the use of the dispenser, the chemical dispensed, the use of the chemical, etc., in response to user proximity. Use liquid chemicals can be derived from liquids, powders or solid block materials. The use chemical is typically provided in the form of pumpable liquid, but can be obtained in the form of a spray, a foam, a powder, a gel, etc. The use locus involved can include a household kitchen, bath or recreational areas or an institutional locus such as a bathroom, a kitchen, a food processing area, a public rest rooms, a day care center, etc. The messages provided by the interactive dispenser can include use chemical identity information, safety instructions, hygiene information or instructions, personal care instructions, chemical use instructions, prompts for the use of the dispenser and any other message that would tend to increase overall safety, hygiene the efficiency of the machine or efficacy in the use of the dispensed use chemical.

BACKGROUND OF THE INVENTION

A variety of both automatic and manual dispensing equipment have been developed for powdered, liquid and solid block detergent materials. Dispensers for powdered materials include the devices disclosed in (e.g.) Salmonson, U.S. Pat. No. 4,063,663. Dispensers for solid block detergents and rinse aids include those disclosed in Copeland, U.S. Pat. Nos. 4,426,362, 5,320,118 and others. Dispensers for personal care liquids including hand soaps, sanitizing hand soaps, hand lotions, etc. include those disclosed in Olson, U.S. Pat. No. 5,248,066 and McDermott, U.S. Pat. No. 4,667,854. Household and institutional cleaning materials for hard surfaces, floors, windows, sinks, tile, etc. are disclosed in Nysten, U.S. Pat. No. 4,691,721; Copeland et al., U.S. Pat. No. 5,033,649; Mehus, U.S. Pat. No. 5,203,366; and Thomas, U.S. Pat. No. 5,255,820. One feature in common in certain dispensing systems comprises a visual indicator or low product alarm indicating that the chemical dispensed by the dispenser system is virtually consumed or depleted. Livingston et al., U.S. Pat. No. 4,509,543, disclose an institutional or industrial dishwasher having a monitor/controller device with machine generated speech capability. The Livingston et al. device substitutes a machine generated speech warning for a typical low product, etc., warning alarm when the monitor/controller detects low product conditions. Further, the dishwasher machine has an array of buttons which can be pressed by an operator. Pressing an appropriate button causes the monitor/controller to provide a machine generated speech relating to the proper operation of the machine in an instructional mode. Visual indicators can include a window or cut-out revealing the chemical level. A low product alarm is triggered by the amount of material in the dispenser and generates either a warning light or alarm buzzer or other aural signal. Maintenance personnel detecting the visual indicator or alarm can then replenish the chemical in the dispenser equipment.

A variety of dispensers are also known with an added feature comprising a proximity sensor. A user proximate to the sensor generates a signal that prompts the dispenser to dispense an amount of the personal care amount directly into the hand of the user. Binderbauer et al., U.S. Pat. No. 4,921,131; Pilola et al., U.S. Pat. No. 4,938,384; and Shiau, U.S. Pat. No. 4,989,755 each teach a proximity detector that detects the presence of, for example, the hand of a user. The HYGEINÔ motion activated soap dispenser, sold by Owstock Motivational Inc., is a consumer device that dispenses about one milliliter of hand soap per proximity prompt cycle. The dispensers are configured to dispense a personal care liquid such as a hand soap into the hand of the user when prompted by the proximity sensor.

We are also aware of a variety of sophisticated interactive systems. A large variety of video games requires a user input that can interface with a microprocessor system to compete in a game. Further, SEGA® and NINTENDO® are video games that rely on user input to generate a game output display. A large number of video games on floppy disk or CD-ROM provide a broad variety of interactive computer situations. These systems are highly complex, involve large input data sets and provide displays of complex gaming and informational displays. We are also aware of a variety of processor based control and data collecting systems that use microprocessor technology to optimize ware washing systems or to collect operational information during the operation of ware washing systems. Such data can be used by operators to optimize the system for dish-type, soil load and time of day parameters. Such computer based systems include the Diverlog system produced by Diversey Inc. and the Controlmax® system disclosed in Brady, U.S. Pat. No. 5,404,893.

BRIEF DISCUSSION OF THE INVENTION

The interactive dispenser of the invention comprises means to dispense a personal use or personal care chemical in response to the proximity of the user. The dispenser provides a message associated with the operation of the dispenser. For the purpose of this invention, proximity means the user is in contact with the device or within a radius from the machine such that (1) the user can see or hear the message produced by the interactive dispenser or (2) the user can interact with a sensor of the dispenser triggering a message, and the personal care or personal use chemical related to that component. The term "proximity" does not include and is not intended to mean a user manually operating a non-dispensing portion of the dispenser such as pressing a switch designed to produce a message associated with a switch label.

The term "proximity" indicates the presence of a user within a detectable radius of a sensor that can detect an aspect of the user's presence. A detected aspect of the user's presence can include body heat, body motion, change in reflectance, use of the dispenser, etc. Heat detectors commonly are sensors that can detect infrared (IR) energy at the intensity commonly released by the proximity of a person. Typically the heat detectors can be set to recognize the presence of an object having a temperature greater than ambient (typically 24°–29° C.). Since the skin surface of typical users are at a temperature of about 35°–37° C., the skin surface of a user can typically be used to trigger such a heat sensor. Preferred other sensing means include motion detectors that sense the motion of the user in proximity to the dispenser case. Motion sensors can detect a change in the environment surrounding the case. Motion sensors can direct an ultrasonic signal into an environment, can send an infrared signal into the environment or can send a variety of other signals into the environment. The proximity of a user alters the signal in such a way that the signal as it returns to the sensor means changes significantly to reveal the motion of the user. Such a motion detector typically comprises a transmitter unit and a receiving unit. The transmitting unit delivers a substantial amount of energy that can be detected by the receiving unit. When no user is proximate to the dispenser, the receiver senses a relatively steady state unchanging input. When a user is proximate to the dispenser, the environment is altered by the motion of the user and the detector portion of the sensor means detects a changing signal which indicates the proximity of the user. This change in frequency causes the sensor to deliver a signal to the controller portion of the dispenser. One embodiment of the invention includes a sensing means that is installed in the dispenser case adjacent to the chemical delivery means. Commonly, the motion of the users hands triggers the sensor and delivers the chemical directly into the users hands. In this embodiment, the sensor is typically positioned within a sufficient distance to the dispensing proximity of the hands to the sensor inherently positions the hands of the user at a location such that the dispenser expresses the material directly into the users hand. The term "personal care chemical" relates to a chemical in a liquid or solid form that is typically applied to hair, skin, mouth, fingernails or any other exterior surface of the human body. The term "personal care liquid chemical" includes a pumpable material including liquid foams, gels, solutions, dispersions that can be made using a liquid vehicle, such as water or a solvent, to dissolve or suspend active and inactive materials. The term "personal use chemical" typically means a liquid or powdered material that can be used by an individual in day to day life. Such chemicals can be used to clean clothing, polish shoes, clean spectacles or contact lens, or provide functional material common in day to day lives of people in an institutional or industrial setting. For the purpose of this application, the term "message" includes an artificial (or synthetic) message or a recorded (digital or analog recording) audio message. The message can be generated by a electronic or mechanical means for generating messages that can be heard by the user. Such means include phonographic disc players, semi-conductor or integrated circuit devices that play an analog or digitally recorded speech, speech synthesizers, tape players, CD players etc. The term "message" can also include a visual message generated by a video screen, lighted scrolled message panel, stationary grid light display or any other visually detected message generating means used in conjunction with the aural message.

BRIEF DISCUSSION OF THE DRAWINGS

FIG. 1 is a perspective front elevational view of the interactive dispenser 10. The dispenser has a housing 11 conformed to the appearance of a fictitious, fabricated or mythical bear image 12. The fictional bear image 12 contains a variety of facial features including a mouth area 13. The interactive dispenser 10 contains a transducer that can provide an aural message. Such messages produced by a transducer (not shown) mounted on the interior of the housing and operatively coupled to the holes in the mouth area 13. The housing 11 covers a liquid dispenser 14 which includes a source of the personal care liquid dispensed by the dispenser, a detector that detects the presence of a user, a message generating system that provides a message signal to the transducer, a power supply and means to dispense the personal care or use liquid. In one aspect of the invention, the housing 11 also contains a motion detector or IR detector that can detect the presence of the user apart from the input that is derived from operation of the dispenser.

Figure 2:
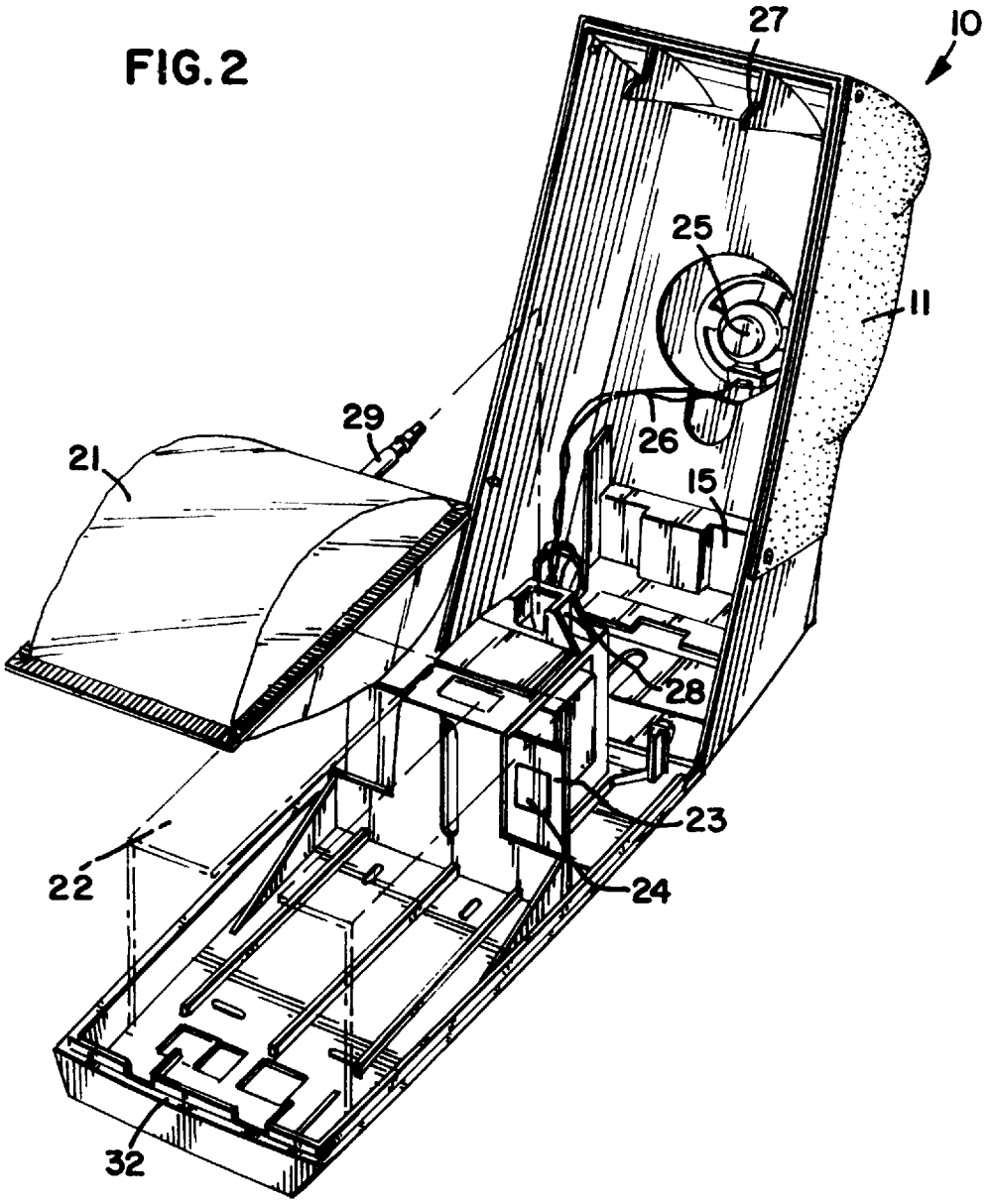

FIG. 2 is an exploded isometric view of the opened interior of the interactive dispenser 10 shown in FIG. 1. FIG. 2 shows the interactive dispenser 10 covered by the housing 11. Inside the interactive dispenser 10 is shown the source of personal care or use liquid, a dispensing means for the liquid, a power supply, an electronic circuit for detecting the presence of a user and for generating a message signal, and a transducer for providing an aural message to the user.

Figure 3:
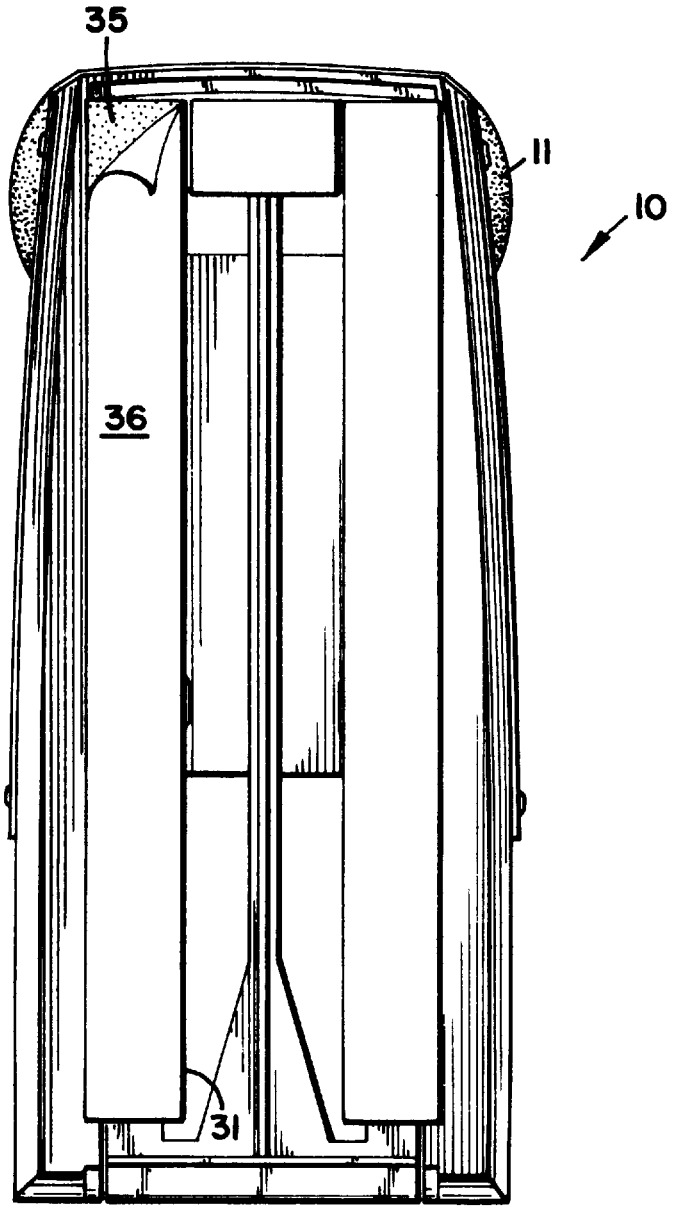

FIG. 3 shows the reverse of the dispenser shown in FIG. 1. The dispenser can be mounted on a wall using the mounting means including adhesive strips.

DETAILED DISCUSSION OF THE INVENTION

In somewhat greater detail, the interactive dispenser can comprise dispenser components installed within a housing. The housing is typically shaped and configured to the form of a mythical, fictional, cartoon-like or the actual form of an existing human being or animal. Such appearance can comprise a portion of the individual or the entire individual body. The typical form of the housing is the head of the individual containing a mouth that can provide speech, that can take the form of any actual, fictional or cartoon-like human or animal shape. Human shapes can include celebrities, cartoon figures, fictional or historical figures, promotional figures, etc. The housing can also be conformed to the shape of a fictional, mythical or cartoon-like animal including bears, raccoons, birds, fish, dolphins, whales, sports mascots, cartoon animals, and others.

In the instance that the housing is configured for children, the housing can take the form of a clown, a children's storybook figure, marketing figures directed to younger populations, etc. The appearance of the housing should correspond to a degree to the message provided by the interactive dispenser. The message should not contradict the obvious character of the speaking portion of the dispenser.

The housing can be a removable housing placed directly over the internal working components of the dispenser. Alternatively, the housing can simply be a removable or replaceable shelf that can be placed over an intact dispenser using removable housing attachments.

The housing, and the important structural components of the dispenser can be molded of a variety of useful materials. Thermoplastic and thermosetting or composite materials can be used to make the housing. Alternatively, the housing can be made from metallic elements, however, polymeric thermoplastic or thermosetting (composite) materials are preferred. Preferably, the housing, dispenser components, etc. can be molded in one or more unitary pieces through the use of conventional plastic injection molding, thermoforming, blow molding, etc. techniques. A variety of plastic polymeric materials can be used in fabricating the holder including polyethylene, polypropylene, ABS plastics, urethane resins, nylon resins and others. Preferred plastic materials include sytrenic materials such as polystyrene or ABS, polyethylene, and polypropylene.

The housing can be blow molded, injection molded, sculptured, shaved, cut or otherwise formed into the shape of the individual delivering the message. After shaping, the housing can be outlined, colored, or otherwise augmented to provide highlighted or colored features corresponding to the individual. Additionally, the housing can have teeth, whiskers, spectacles, hair, or other appearance attributes applied to the housing to increase visibility, recognition or realism.

The housing should include facial features that can provide a message. Such facial features typically include mouth or mouth parts including lips, teeth, optionally larynx and other speech generating equipment. Such features in the housing can be closely associated with a transducer that can produce speech.

The dispenser contains a source of the liquid chemical and means to dispense the liquid chemical. As discussed below, the chemical can be provided in the form of a cartridge or flexible bag containing the chemical. Typically, the cartridge or flexible bag has a dispensing port from which the liquid chemical can be delivered to the user. Such a port can work cooperatively with dispensing means actuated by the user. The dispensing means can be a simple mechanical valve or pump, an electrical generated pump, or any other known device that can produce a useful volume of the liquid chemical. The dispenser of the invention typically provides about 0.25 to 5 milliliters of liquid chemical for use depending on the type of use chemical. For liquid hand soap or sanitizing hand soap, the amount of soap can range from about 1 to about 3 milliliters in volume. A preferred means of delivering the liquid from the dispenser comprises a flexible compressible tube that can act as a pump portion. When used, the user compresses a bar or other feature on the front of the housing. Such compression forces a compressing surface against the flexible tube. The flexible tube contains internal valve means that prevent backflow of the liquid from the tube into the bag or cartridge. The compression of the tube and the valves cooperate to ensure that the liquid is expressed from the flexible tube into the hands of the user. The flexible tube is typically positioned in the housing in a location convenient to the location of the housing portion that triggers dispensing of the liquid.

The inactive dispenser of the invention comprises an exterior shell or case that can include the working parts of the dispenser. The dispenser can be placed in any location such that the sensor can detect the proximity of a user and supply the user with chemical. The dispenser can be permanently or removably mounted on a wall or counter surface using mounting means. Further, the dispenser can be configured for table top use. Such a table top dispenser can have a support or base that maintains the dispenser in a position or attitude such that the user can approach the dispenser, and become sufficiently proximate to the dispenser to trigger the sensor and the release of the care or use chemical.

The shell or case also comprises a containment means or holding means for the chemical. Such a holding means can comprise a reservoir or chamber that can contain a sufficient quantity of chemical to satisfy requirements for a period of use of the chemical. A period of use can comprise one day, two days, a week, two weeks or a month or more of use. The period of use depends on the type of chemical, its shelf life and rate of use. Such holding means can comprise a volume within the case of at least 50 ml, preferably 100 ml to 5 liters of volume. Most preferably, the volume of the holding means is about 150 to 500 ml for reasons of convenience and ease of insertion.

In a preferred mode, the chemical is encased in a flexible bag or cartridge that can be inserted into the holding means of the case. A cartridge can have any arbitrary shape. Useful shapes include cylinders, cubes, rectangular solids, triangular solids, cones, truncated cones, bottle shapes, or any arbitrary shape designed to fit particularly in a holding means of a particular dispenser. Such bags or cartridge shapes can have unique shapes to ensure that a cartridge is designed to fit in a particular dispenser and intended to dispense a particular chemical. Such bags or cartridges can be made from cardboard, paperboard, etc.; metallic substances such as aluminum, metallized polyester; thermoplastic such as polyethylene, polypropylene, polyethylene terephthalate, polyvinyl chloride, polystyrene, a thermoplastic composite material, etc. Such cartridges can be sized as discussed above to contain a sufficient volume or weight of chemical to satisfy requirements for a given period.

The liquid chemical can be provided in the form of the contents of a flexible bag. The contents can be removed by applying pressure to the bag or by pumping liquid from a tube attached to the bag.

The bag or cartridge of the invention is typically equipped with a closed chemical port. Typically, the port comprises a flexible tube from which the liquid can be dispensed. The bag or cartridge is designed to deliver the chemical through the port after the closed port is opened. The port can be opened by removal of a closing membrane, piercing a membrane, removing a screw cap, or separating any of a variety of conventional closing means from the cartridge portal. In a preferred mode, the portal is covered by a cap or a paper, film, metallized film, or other thin piercable web closure. When the cartridge is inserted into the holding means, the web closure contacts an opening means that can pierce the web closure. The opening means is shaped and configured to provide a sufficient aperture in the web closure to permit a sufficient volume of the chemical to be dispensed for appropriate operation. The opening means can be configured to remove the portion of the opening means away from the portal to ensure that the opening does not become plugged. Such a bag or cartridge can be loosely fitted into the holding means of the case or can be shaped to conform exactly to the exterior shape of the cartridge. The holding means can also include a lid or cover such that the cartridge is fully enclosed by the case and cover. Such a cover can be removable or can be hingedly attached or slidingly attached to the case.

The interactive dispenser of the invention can be used to dispense a powdered, liquid, etc. chemical in the form of a liquid personal use or care chemical. Such materials can include hand cleaners, sanitizing hand cleaners, hand and body lotion, sunblocks, sunscreens, poison ivy treatment materials, burn ointments, body treatments, etc. Such materials are typically formulated on an aqueous or aqueous alcoholic liquid. The preferred material for use in the dispenser of the invention is a liquid hand soap, a sanitizing hand soap, a body soap or shampoo for personal care. Such materials are formulated to remove mixed soils, typically having an oily or fatty base. Such soaps are generally based on an aqueous solution or suspension containing an organic surfactant material. Such materials can be formulated with surfactants, builders, organic additives, perfumes, dyes, humectants, stabilizers, moisturizing agents, sanitizing agents, sequestrants, etc. The typical hand cleaner and sanitizing hand cleaner are well known materials having useful viscosities for dispensing. The liquid soap can be dispensed from the dispenser in the form of a liquid cleaner or foam.

In the instance that the dispenser generates a foam chemical, the cartridge insert can comprise or include a pressurized cartridge insert. Such cartridge inserts are typically metallic cans filled with chemical and/or propellant. The cans are often typically equipped with a valve system which when actuated, can release the propellant or can use the propellant to express the material within the can through a foaming orifice. Typical propellants include carbon dioxide, propane, nitrous oxide and other well known hydrocarbon propellant gases.

The case includes a sensing means that can detect the proximity of a user. The sensor when prompted by the proximity of the user delivers a signal to the controller mechanism of the dispenser that causes the delivery of the useful quantity of the chemical from the delivery means of the dispenser and the aural message that can either be heard by the user. The sensor is typically mechanically or electronically coupled to a controller having electrically components that drive the chemical delivery system and the message delivery system.

Sensors that can be used to detect the proximity of a user include any of a variety of sensors commonly used. Such sensors can generate a signal upon use of the dispenser sensing energy such as ultrasonic energy having a frequency greater the 25,000 Hz, sound energy having a frequency less than 25,000 Hz (typically from about 100 to 10,000 Hz), light energy, heat energy, electrical energy or any other sensing means that can trigger an appropriate signal. Preferred sensing means include detection of the use of the dispenser. Such use of the dispenser is typically sensed through the operation of a button, push bar, or other mechanical or electrical pumping device that can cause dispensing of the liquid chemical from the dispenser. Such a bar is coupled to an electronic control system which then is actuated to produce the message signal which is transferred to the transducer resulting in production of the aural message.

The interactive dispenser of the invention contains means to generate a message that can be heard by the user. Such means typically includes an electronic controller circuit coupled to a transducer. Electronic controller circuits that can generate a message include large integrated circuit devices that can be programmed to develop a synthesized speech which can be directed through an amplifier into the transducer for message delivery. Alternate means for generating a message include prerecorded tape messages, prerecorded compact disk messages, computer derived synthetic speech, or any other known electronic means that can provide a message to the user. Such means to provide the message to the user typically is triggered by the sensor discussed above. The sensor which detects the use of the dispenser or the presence of the user provides a signal to the electronic control means which then produces the message signal which is then transferred to the transducer which converts the signal into the appropriate message for the user. For the purpose of this invention, the term "transducer" indicates a mechanical or electrical device that can change the message signal into an aural message that can be heard by the user. Common transducers include audio speakers, etc. A preferred means to produce the message signal includes programmable integrated circuit devices that are programmed to provide short messages having 1 to 50 words.

The message delivered by the interactive dispenser of the invention can be any message that can be appropriate from the identity of the individual delivering the message, can be any message relating to the personal care chemical or personal use chemical, can be a message directed to safety of using the environment of the dispenser, or can be any arbitrary message in an informational, promotional, educational entertainment, etc. In a preferred mode, the message delivered by the interactive dispenser relates to the use of the liquid hand soap or the sanitizing liquid hand soap. Such a message can be directed to the appropriate use of the hand soap to ensure cleanliness and substantial reductions in microorganisms in the user. The message can remind the user to use the dispenser, can instruct the user in the appropriate operation of the dispenser or other related equipment, can promote cooperation and intelligent use of the dispenser by groups of individuals using the facilities. The interactive dispenser can provide one, two or more messages at each use of the dispenser. In such a mode, an instructional message can be combined with a promotional message or an informational message can be coupled with an entertainment message. Typically, the messages are short, last less than one minute and are delivered using a voice that is appropriate to the dispenser configuration, the likely audience and the environment of the dispenser. Examples of typical messages that have been developed for different aspects of the dispenser of the invention are as follows:

Ronald Message

1) Thanks for remembering to wash your hands.
2) Hand washing is an important part of staying healthy and preventing the spreading of germs.
3) Now that your hands are clean you are ready to eat. Enjoy your meal.

Bear Dispenser

1) Hi, I'm EcoBear the automatic hand soap dispenser.
2) Did you know there are many different types of bears in North America; Black Bears, Polar Bears, Grizzly Bears, and Brown Bears.
3) EcoBear says, "don't forget to wash your hands".

DETAILED DISCUSSION OF THE DRAWINGS

FIG. 1 is a perspective view of the interactive dispenser of the invention. The interactive dispenser 10 comprises a housing conformed into the shape of an individual 11 attached to a liquid dispenser 14. The housing is conformed to the shape of a cartoon-like or fictional bear character. The bear character has typical features including ears 18, nose 19, eyes 17, mouth and mouth region 13. The liquid dispenser 14 (partially hidden) contains the working dispenser apparatus for providing the personal use or personal care liquid to the user. In this embodiment, the user interacts with the push bar 15 which pumps personal use or personal care liquid from a container 21 (not shown, see FIG. 2) through a tube 29 (not shown, see FIG. 2) out of nozzle 16 hidden by the push bar 15. The liquid dispenser 14 contains means to generate an aural message signal that is delivered to a transducer (not shown) that delivers the message from the housing 11. The transducer is positioned behind the mouth area 13 such that the transducer (not shown) provides the aural message through the message apertures 13 in the housing 11. In this way, the message is associated with the mouth region of the individual and appears natural and understandable by even the youngest user. The liquid dispenser 14, not including the individual shaped housing and the message generating means, is similar to the dispenser shown in Olson et al., U.S. Pat. No. 5,248,066, which is expressly incorporated by reference herein.

FIG. 2 is a view of an open interactive dispenser 10. FIG. 2 shows the reverse view of the housing 11 and reveals the internal components of the message signal generating system including a printed circuit board 23, a message generating component 24, a transducer (speaker) 25 and wire connections 26 between the printed circuit board 24 and the speaker 25. In operation, when the push bar 15 is depressed, the detection of the use of the push bar triggers the generation of a message signal in the electronic component 24 of the printed circuit board 23. The message signal leaves the printed circuit board 23, passes through the wires 26 and is delivered from the speaker 25. The interior of the dispenser also includes a flexible bag 21 containing the personal care or personal use liquid of the invention. The personal care or use liquid is delivered through tube 29 having a nozzle 16 to the user when pumped by the push bar 15. The flexible bag of the personal care liquid is supported in the dispenser using housing 22 shown in phantom. The housing also includes a closing latch means 27 which interacts with a cooperative mating means 32 to hold the dispenser closed when used. In one alternative, an electric pump 28 can be installed to pump personal care liquid from the flexible bag 21 through the tube 29 out of nozzle 16.

FIG. 3 is a reverse perspective view of the rear of the interactive dispenser 10 of the invention. A portion of the housing 11 can be seen. The dispenser can be mounted on a wall using attachment means 31 (adhesive strips 35 covered by release liners 36). In use, the release liners 36 are removed exposing the sticky adhesive surface 35 which mounts easily to a use locus.

The above specification, examples and data provide a complete description of the manufacture and use of the combination of the invention. Since many embodiments of the invention can be made without departing from the spirit and scope of the invention, the invention resides in the claims hereinafter appended.

We claim:

1. An interactive communicating dispenser for a personal use chemical or a personal care chemical, the dispenser configured to provide a message to an individual user, the dispenser comprising:

(a) a housing configured in the shape of an individual capable of providing a aural message, the housing comprising a shell containing a transducer that can provide the message and a detection means to detect the presence of an individual user within sufficient proximity to the dispenser for effective communication, said proximity causing a proximity signal;

(b) means, coupled to the detection means, to provide a message signal to the transducer when the proximity signal is received;

(c) a source of the personal care liquid; and (d) means for dispensing the personal care liquid in response to the proximity signal.

2. The dispenser of claim 1 wherein the personal care liquid comprises a liquid soap or a sanitizing liquid soap.

3. The dispenser of claim 2 wherein the personal care liquid is a foaming material.

4. The dispenser of claim 1 wherein the detection means is a motion detector.

5. The dispenser of claim 1 wherein the detection means is an infrared heat detector.

6. The dispenser of claim 1 wherein the detection means is a sound detector.

7. The dispenser of claim 1 wherein the detection means is an ultrasonic detector.

8. The dispenser of claim 1 wherein the means to dispense the personal care liquid is a mechanical pump.

9. The dispenser of claim 8 wherein the means to dispense the personal care liquid is an electrical motor driven pump.

10. The dispenser of claim 1 wherein the message is in an electronic voice.

11. The dispenser of claim 10 wherein the message is in an recorded human voice.

12. The dispenser of claim 11 wherein the recorded human voice is digitized.

13. The dispenser of claim 10 wherein the message also includes a visual message.

14. The dispenser of claim 13 wherein the visual message is a video image or an electronic scroll.

15. The dispenser of claim 1 wherein the transducer is placed in the housing in a location corresponding to the source of the aural message.

16. An interactive communicating dispenser for a personal care liquid that can suggest a use of the dispenser to dispense the liquid to an individual, the dispenser comprising:

(a) a housing configured in the shape of an individual capable of providing an aural message, the housing comprising a shell containing a transducer that can provide the message and a detection means to detect the presence of an individual at a distance less than 10 centimeters from the dispenser, said proximity causing a proximity signal;

(b) means, coupled to the detection means, to provide a message signal when the proximity signal is received, suggesting that the individual uses a personal care liquid;

(c) a source of the personal care liquid; and (d) means for dispensing the personal care liquid in response to the proximity signal.

17. The dispenser of claim 16 wherein the personal care liquid comprises a liquid hand soap or a sanitizing liquid hand soap.

18. The dispenser of claim 17 wherein the personal care liquid comprises a hand lotion.

19. The dispenser of claim 16 wherein the detection means is a motion detector.

20. The dispenser of claim 16 wherein the detection means is an infrared heat detector.

21. The dispenser of claim 16 wherein the detection means is an sound detector.

22. The dispenser of claim 16 wherein the detection means is an ultrasonic detector.

23. The dispenser of claim 16 wherein the means to dispense the personal care liquid is a mechanical pump.

24. The dispenser of claim 16 wherein the means to dispense the personal care liquid is an electrical motor driven pump.

25. The dispenser of claim 16 wherein the message is in an artificial electronic voice.

26. The dispenser of claim 16 wherein the message is in an recorded human voice.

27. The dispenser of claim 16 wherein the recorded human voice is digitized.

28. The dispenser of claim 25 wherein the message also includes a visual message.

29. The dispenser of claim 28 wherein the visual message is a video image or an electronic scroll.

* * * * *